US010967249B2

(12) United States Patent
Margareten

(10) Patent No.: US 10,967,249 B2
(45) Date of Patent: Apr. 6, 2021

(54) GAMING DEVICE

(71) Applicant: Bulk Unlimited Corp., Brooklyn, NY (US)

(72) Inventor: Isamar Margareten, Brooklyn, NY (US)

(73) Assignee: Bulk Unlimited Corp., Brooklyn, NY (US)

( * ) Notice: Subject to any disclaimer, the term of this patent is extended or adjusted under 35 U.S.C. 154(b) by 0 days.

(21) Appl. No.: 16/244,992

(22) Filed: Jan. 10, 2019

(65) Prior Publication Data

US 2019/0321718 A1 Oct. 24, 2019

Related U.S. Application Data

(60) Provisional application No. 62/660,093, filed on Apr. 19, 2018.

(51) Int. Cl.
*A63F 9/24* (2006.01)
*A63F 9/02* (2006.01)

(52) U.S. Cl.
CPC ..... *A63F 9/0291* (2013.01); *A63F 9/0204* (2013.01)

(58) Field of Classification Search
CPC ..... A63F 9/0291; A63F 9/0204; A63F 2009/2444; A63F 2250/49; F41J 5/02
See application file for complete search history.

(56) References Cited

U.S. PATENT DOCUMENTS 5,904,621 A * 5/1999 Small ..... F41A 33/02 434/22
5,984,788 A * 11/1999 Lebensfeld ..... A63F 9/0291 463/51
6,302,796 B1 * 10/2001 Lebensfeld ..... A63F 9/0291 446/175
8,469,824 B1 * 6/2013 Farley ..... F41J 5/02 434/11
2005/0279004 A1 * 12/2005 Woodmansee, III ... F41C 27/00 42/146
2006/0287113 A1 * 12/2006 Small ..... A63F 9/0291 463/51
2008/0188314 A1 * 8/2008 Rosenblum ..... F41A 33/02 463/52
2010/0016085 A1 * 1/2010 Inoue ..... A63F 9/0291 463/51

(Continued)

OTHER PUBLICATIONS

Laser Tag. Aberdeen.extremefuncenters.com. Online. Mar. 17, 2017. Accessed via the Internet. Accessed Mar. 14, 2020. <URL: https://web.archive.org/web/20170316211149/https://aberdeen.extremefuncenters.com/laser-tag/> (Year: 2017).*

*Primary Examiner* — Dmitry Suhol
*Assistant Examiner* — Carl V Larsen
(74) *Attorney, Agent, or Firm* — Michael Steinmetz

(57) ABSTRACT

The present invention provides a gaining device for playing a game of laser tag. The gaining device includes a controller configured to control and coordinate functions between various components thereof. The gaining device includes an aiming unit configured to generate infrared light signals and a receiver configured to detect the generated infrared light signals. The gaining device includes a targeting unit configured to generate a vibration when the receiver in the targeting unit detects infrared light signals. The gaining device further includes one or more lights configured to indicate one or more states of the aiming unit and targeting unit. The controller is configured to engage the aiming unit and targeting unit in a stealth mode in which the one or more lights are switched off.

15 Claims, 5 Drawing Sheets

(56) References Cited

U.S. PATENT DOCUMENTS

| | | | | |
|---|---|---|---|---|
| 2013/0184085 | A1* | 7/2013 | Clark | A63F 9/0291 463/56 |
| 2017/0079329 | A1* | 3/2017 | Zitzke | A24F 47/008 |
| 2018/0229108 | A1* | 8/2018 | Waldman | A63F 9/0291 |
| 2018/0353845 | A1* | 12/2018 | Fischer | A63F 9/24 |

* cited by examiner

GAMING DEVICE

BACKGROUND OF THE INVENTION

1. Field of the Invention

The present disclosure generally relates to a gaining device; and more particularly relates to a laser tag gaining device, which provides an option to be played with one or more sets of aiming units and targeting units, or sets of aiming units only.

2. Description of the Related Art

Laser tag is a popular, competitive game which is played between two or more players located in the same vicinity. Usually, the players are divided into two or more teams with the objective being to eliminate the members of the other teams from the game. The laser tag game utilizes "guns" which incorporate an infrared emitter and, often, an infrared receptor therein. A player from one team aims his/her gun at another player from the opposing team and pulls the trigger. The trigger activates the infrared emitter on the gun to generate an infrared beam or signal. The infrared signal travels toward the infrared receptor of the gun of the other player. If the aim has been generally on target, the infrared signal activates the infrared receptor on the other player, to inform the player that he/she has been tagged or "hit." When a pre-determined number of hits have been recorded by the infrared receptor, a visual or audible alarm is activated informing the player that he/she has been eliminated from the game.

Although, the existing laser tag devices generally work to provide an enjoyable experience to the players participating in the game, the lack of certain features results in the failure of such devices to provide an enhanced experience to the players. For instance, the guns utilized in existing devices are often provided with one or more colored lights (e.g., to identify and distinguish the opposing team members), but these lights lead to the player being detected by the opposing players when the player is trying to hide in the dark, say, for executing a surprise attack on one or more opposing players. Further, existing devices require all the players to utilize both the guns as well as "vests" for all game plays, which may not always be desirable in some situations. An enhanced experience for the players of such games may also include multiple creative modes of play to make such games more interesting and challenging.

The various documents describing the closest subject matter provide for a number of more or less complicated features that fail to provide an enhanced experience to the players in a convenient and efficient manner. None of these documents suggest the novel features of the present invention.

SUMMARY OF THE INVENTION

It is one of the main objectives of the present invention to provide a gaining device for playing a game of laser tag with either a combination of an aiming unit and a targeting unit, or the aiming unit only.

It is still another objective of the present invention to provide a gaining device which allows a player to engage a "stealth mode" during the game play as required.

It is another objective of the present invention to provide a gaining device in which the aiming unit and the targeting unit are portable to carry, inexpensive to manufacture, and convenient to use.

Further objectives of the invention will be brought out in the following part of the specification, wherein detailed description is provided for the purpose of fully disclosing the invention without placing limitations thereon.

BRIEF DESCRIPTION OF THE DRAWINGS

With the above and other related objectives in view, the invention consists in the details of construction and combination of parts, as will be more fully understood from the following description, when read in conjunction with the accompanying drawings in which.

DETAILED DESCRIPTION OF THE EMBODIMENTS OF THE INVENTION

Illustrative embodiments of the present invention are described below. The following explanation provides specific details for a thorough understanding of and enabling description for these embodiments. One skilled in the art will understand that the invention may be practiced without such details. In some instances, well-known structures, processes, and functions have not been shown or described in detail to avoid unnecessarily obscuring the description of the embodiments.

It shall be noted that unless the context clearly requires otherwise, throughout the description, the words "comprise," "comprising," "include," "including," and the like are to be construed in an inclusive sense as opposed to an exclusive or exhaustive sense; that is to say, in the sense of "including, but not limited to." Words using the singular or plural number also include the plural or singular number, respectively while adhering to the concepts of the present invention. Furthermore, references to "one embodiment" and "an embodiment" are not intended to be interpreted as excluding the existence of additional embodiments that also incorporate the recited features.

Figure 1:
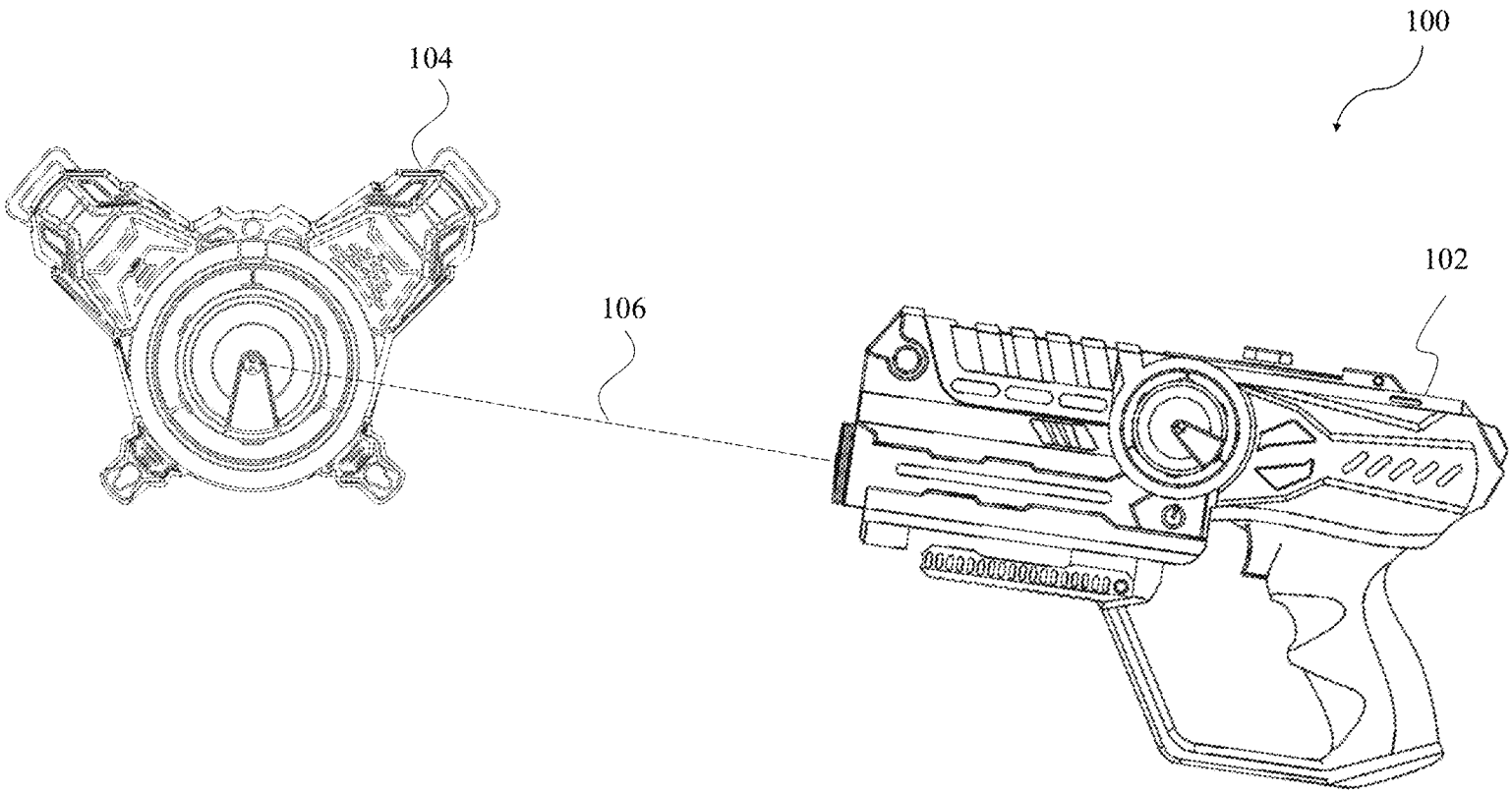
FIG. 1 illustrates a depiction of a gaining device in a game play, in accordance with one or more embodiments of the present disclosure.

Referring to the drawings, FIG. 1 illustrates a gaining device (depicted by the numeral 100) in a game play, in accordance with one or more embodiments of the present disclosure. The gaining device 100 is configured for facilitating a game of tag, commonly known as "laser tag," or sometimes "lazer tag," using infrared light signals (depicted as dashed line 106) or beams between a plurality of players. The gaining device 100, generally, includes an aiming unit 102, and, optionally, a targeting unit 104. The objective of the game play is for a player (or players of one team) to eliminate an opposing player (or required number of opposing players of one or more other teams) by "shooting" infrared light signals 106 from the aiming unit 102 to target the opposing player. A "shot" as described herein may refer to an infrared light signal 106 generated by the aiming unit 102. A "hit" as described herein may refer to an infrared light signal 106 activating the aiming receiver 216 or target receiver 304 of a player, to inform the player that he/she has been tagged. For this purpose, in one example, the player may target the opposing player by generating the infrared light signals 106 using the aiming unit 102, and particularly with the infrared light signal 106 being in the direction of the targeting unit 104 worn by the opposing player. Further, in some examples, the signal may be known signals in the art, such as radio frequency and cellular. It may be understood that the game play may have many different variations without affecting the scope of the present disclosure.

Figure 2:
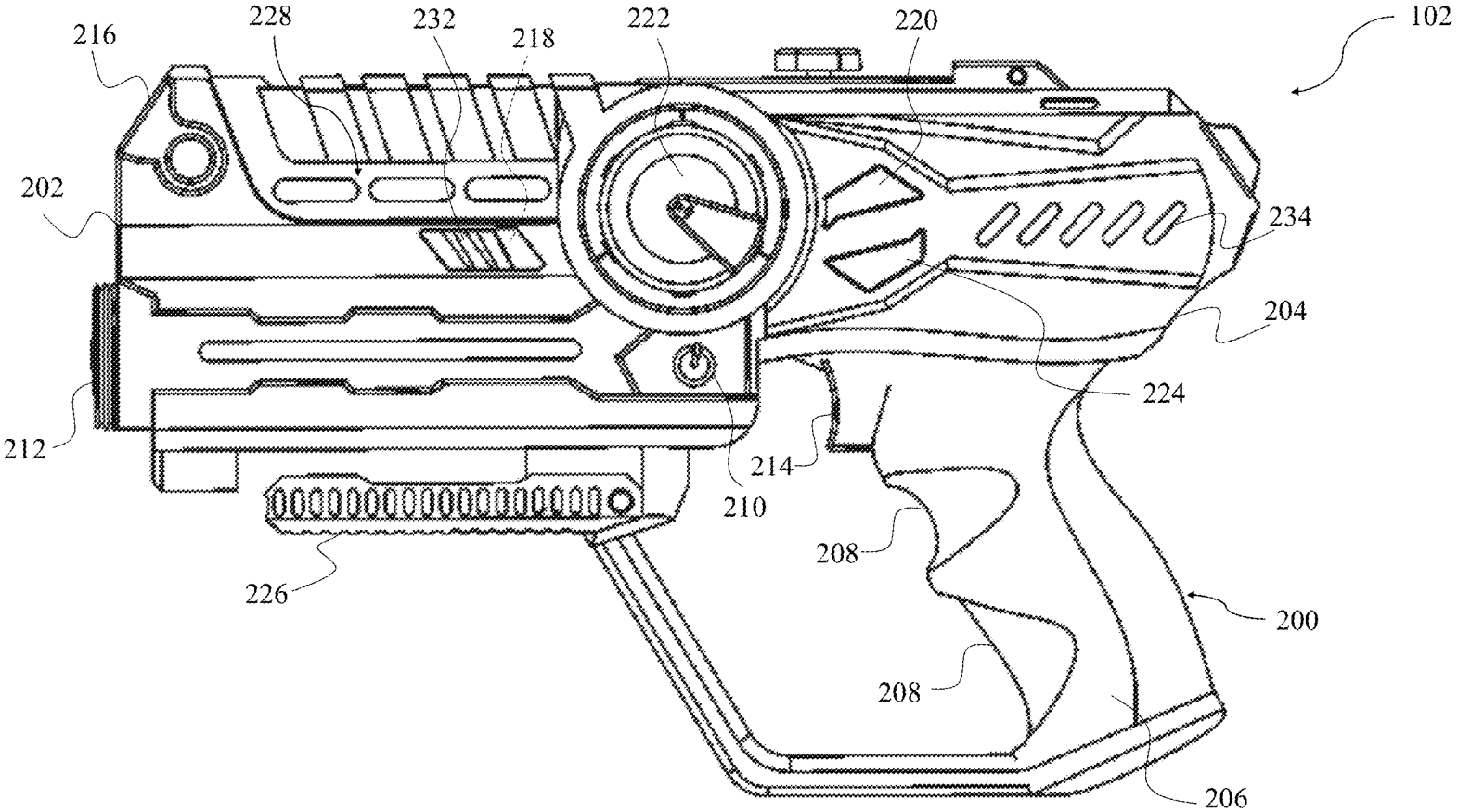
FIG. 2 illustrates a diagrammatic view of an aiming unit of the gaining device, in accordance with one or more embodiments of the present disclosure.

FIG. 2 illustrates a diagrammatic view of the aiming unit 102, in accordance with one or more embodiments of the present disclosure. The aiming unit 102 includes an aiming housing 200 having a forward end 202 (distal to where the player typically holds the aiming unit 102 while the game is being played) and a rear end 204 (proximal to where the player typically holds the aiming unit 102 while the game is being played). The aiming unit 102 is generally shaped in the form of a "gun." The aiming housing 200 provides a grip 206 located towards the rear end 204 thereof, for holding the aiming unit 102. In one or more examples, the grip 206 may have one or more depressions 208 formed therein in order for the player to rest his/her fingers for comfortably holding the aiming unit 102 during the extended game play. In one or more examples, the aiming unit 102 may include a controller (not shown) which may be enclosed inside the aiming housing 200, and controls and coordinates the various functions of the aiming unit 102, as discussed in the subsequent paragraphs.

The aiming unit 102 includes a first switch 210 which is utilized for disposing the aiming unit 102 in ON/OFF mode. The aiming unit 102 includes at least one transmitter 212 which is located at the forward end 202 of the aiming housing 200. The transmitter 212 is configured to generate encoded infrared light signals 106, as per received instructions from the controller. In some examples, the aiming unit 102 may also include a lens (FIG. 3) or the like which may be provided at the forward end 202 (in front of the transmitter 212), and is used to focus infrared light signals 106 transmitted from the transmitter 212 away from the aiming unit 102. The aiming unit 102 further includes a trigger 214 which is, typically, in the form of a lever provided proximal to the grip 206, such that an index finger of the player may naturally rest on the trigger 214 when the aiming unit 102 is being held from the grip 206. The trigger 214 is configured to activate the transmitter 212 to generate the infrared light signals 106. In other words, the transmitter 212 is configured to generate encoded infrared light signals 106 responsive to the trigger 214. It may be understood that the transmitter 212 may generate the infrared light signals 106 only when the aiming unit 102 is disposed in ON mode, via the first switch 210.

Figure 3:
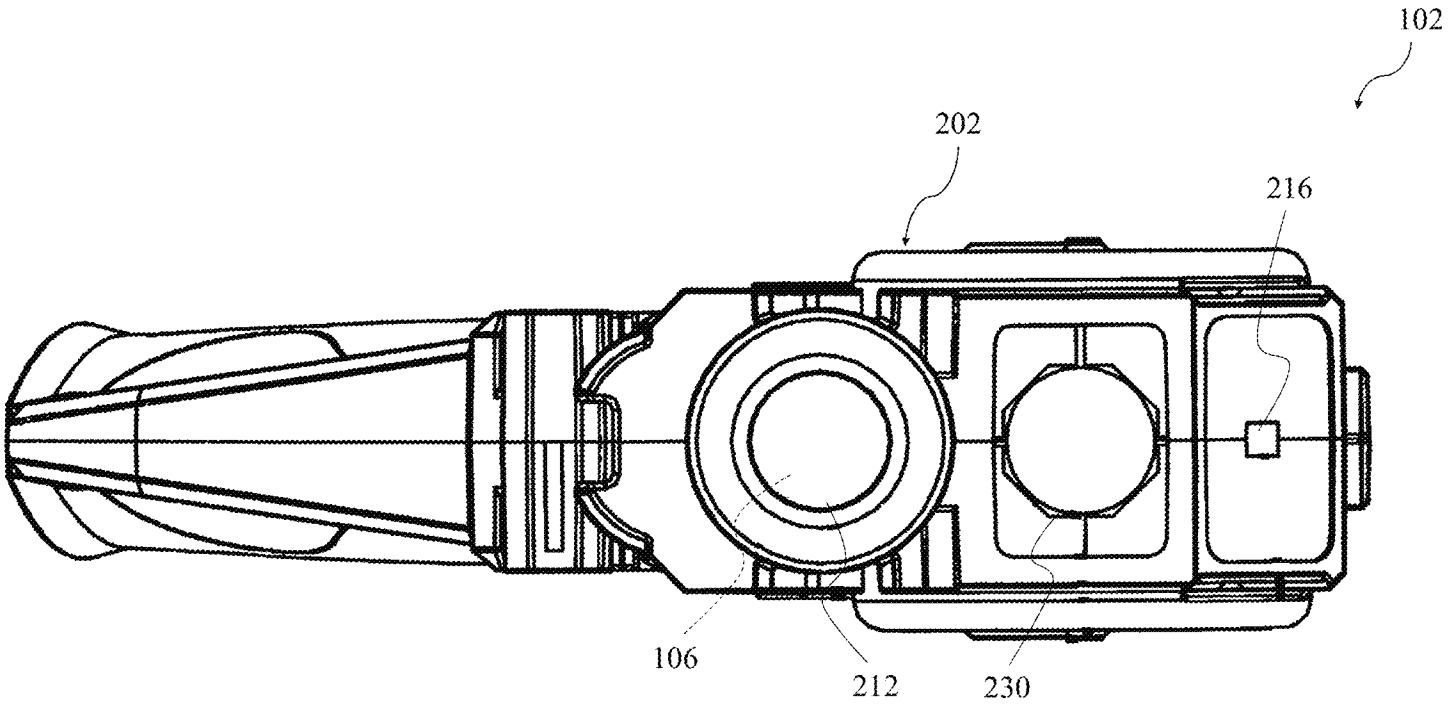
FIG. 3 illustrates a diagrammatic front view of an aiming unit of the gaining device, in accordance with one or more embodiments of the present disclosure.

FIG. 3 illustrates a diagrammatic view of the forward end 202 of the aiming unit 102, in accordance with one or more embodiments of the present disclosure. In one or more embodiments, the aiming unit 102 also includes an aiming receiver 216, which is configured to detect the infrared light signals 106 from other aiming units (similar to the aiming unit 102) in the vicinity. The aiming receiver 216 may only detect the infrared light signals 106, which are generally being transmitted in the direction thereof, for example, infrared light signals 106 with the aiming receiver 216 being the target. It may be understood that the aiming receiver 216 may be any sensor known in the art capable of detecting and decoding information from the infrared light signals 106, such as the infrared light signals 106 generated by the transmitter 212 of the present aiming unit 102. The aiming unit 102 may also include a flashlight 230, for example, a green flashlight 230, or a flashlight 230 in any other color.

FIG. 2 further illustrates that the aiming unit 102 may also include a second switch 218 located on one side of the aiming housing 200; however, it may be contemplated that the second switch 218 may be located at any other suitable location. The second switch 218 is utilized for switching ON/OFF the aiming receiver 216, so as to dispose the aiming unit 102 in either transmitting as well receiving mode (i.e., when the second switch 218 is ON) or only transmitting mode (i.e., when the second switch 218 is OFF). In various examples, the aiming unit 102 may also include a corresponding third switch 232 to turn ON/OFF the flashlight 230, as illustrated in FIG. 3. The player may use the flashlight 230 in dark conditions to provide some light in order to find the other players in the vicinity thereof. In an embodiment, the second switch 218 and third switch 232 are located on opposite sides of the aiming housing 200. In some examples, the aiming unit 102 may also include means to change the intensity of the light generated by the flashlight 230 therein.

In an embodiment, the aiming unit 102 also includes an aiming team selection button 220 which is located proximal to the trigger 214, so that the player may easily reach the aiming team selection button 220 with his/her thumb or the like. The pressing of the aiming team selection button 220 cycles and switches the aiming unit 102 between different pre-configured teams. For instance, the game may have four teams, namely "RED" team, "BLUE" team, "GREEN" team, and "ORANGE" team. In such case, the player may repeatedly press the aiming team selection button 220 until the desired team has been selected. The aiming unit 102 may also include an aiming team indicator light 222 configured to indicate a state of the aiming unit 102. The aiming team indicator light 222 lights up in the color of the selected team, i.e. either in "RED" color, "BLUE" color, "GREEN" color, and "ORANGE" color to distinguish between and identify members of different teams. It may be contemplated that although the given example provides four teams only, the other examples may have more or lesser number of teams without any limitations.

Further, in an embodiment, the aiming unit 102 includes a weapon selection button 224 which is also located proximal to the trigger 214 and next to the aiming team selection button 220, so that the player may easily reach the weapon selection button 224. The weapon selection button 224 may be pressed consecutively to switch and dispose the aiming unit 102 between different weapon modes; for example, "SHOTGUN" mode, "MACHINE GUN" mode, "ROCKET" mode, and "PISTOL" mode. Each weapon mode includes a different amount of pre-loaded shots for the aiming unit 102, and a different amount of lives taken per shot (on target) from the opposing player. It may be understood that each player is given a particular number of lives at the start of the game, for example, nine (9) lives; and once the player has exhausted the given number of lives (by receiving hits), that particular player is eliminated from the game. The below 'Table A' provides an exemplary number of pre-loaded shots per weapon mode, and different amount of lives taken per shot in that particular weapon mode. As may be contemplated from the 'Table A' below, it may require nine (9) number of shots on target from the aiming unit 102 in "PISTOL" mode to eliminate an opposing player, whereas only three (3) number of shots from the aiming unit 102 in "ROCKET" mode may be sufficient to achieve the same purpose. However, it may also be contemplated that the aiming unit 102 in "ROCKET" mode has to be reloaded after very shot while the aiming unit 102 in "PISTOL" mode may be able to provide twelve (12) number of shots before the need of reloading the aiming unit 102. It may be understood that the controller in the aiming unit 102 may encode the infrared light signals 106 in different ways in order to register the weapon mode of the aiming unit 102.

TABLE A

| | Pistol | Shot Gun | Machine Gun | Rocket |
|---|---|---|---|---|
| Pre-loaded Shots | 12 | 5 | 9 | 1 |
| Lives taken per shot | 1 | 2 | 2 | 3 |

As noted earlier, the aiming unit 102 is pre-loaded with only a limited number of shots by default. The aiming unit 102 of the present disclosure further includes a reload lever 226 which allows to reload a default number of shots therein for further game play. For this purpose, the player may tap the reload lever 226 once during the game play to load a default number of shots in the aiming unit 102 based on the present weapon mode thereof. For instance, if the aiming unit 102 is in "PISTOL" mode, engaging the reload lever 226 may result in twelve (12) number of shots being available for further shooting from the aiming unit 102, irrespective of the number of already existing shots available before the reloaded lever 226 was engaged. That is, upon engaging the reload lever 226, the previously available shots are discarded and a default number of shots as per the weapon mode are loaded into the aiming unit 102. It may be contemplated by a person skilled in the art that providing a lever for the reload purposes instead of a button or the like may result in more satisfactory reload experience and thus better simulated game play for the players.

As noted earlier, each player is given a limited number of lives in a game play. In an embodiment, the aiming unit 102 also includes an aiming life indicator arrangement 228 which indicates the state of the aiming unit 102. The aiming life indicator arrangement 228 indicates to the corresponding player the number of lives remaining for that player in the game play before that particular player will be eliminated from the game. In the present examples where each player is given a total of nine (9) number of lives in a single game play, the aiming life indicator arrangement 228 includes three (3) number of lights, such that each of the three (3) lights corresponds to three (3) number of lives. Therefore, at the start of the game play, all three (3) lights in the aiming life indicator arrangement 228 will be turned ON. When the player has been hit by an opponent three (3) number of times, the first of the three (3) lights in the aiming life indicator arrangement 228 will be turned OFF indicating the loss of three (3) number of lives. Subsequently, when the player has been again hit three (3) number of times, the second of the three (3) lights in the aiming life indicator arrangement 228 will be turned OFF indicating loss of another three (3) number of lives. And again, when the player has been hit three (3) number of times, the third of the three (3) lights in the aiming life indicator arrangement 228 will be turned OFF indicating the loss of all nine (9) number of lives. In sequence, the first hit by an opponent causes the first of the three (3) lights in the aiming life indicator arrangement 228 to blink slowly, the second hit causes the first of the three (3) lights in the aiming life indicator arrangement 228 to blink rapidly, and the third hit turns OFF the first of the three (3) lights in the aiming life indicator arrangement 228; and this sequence repeats for the second and third lights in the aiming life indicator arrangement 228, until all nine (9) number of lives are taken. This way by looking at the aiming life indicator arrangement 228, the player may be able to estimate the remaining number of lives upon exhaustion of which he/she will be eliminated from the current game play.

In some embodiments, the aiming life indicator arrangement 228 further includes an audio means, such as an aiming speaker 234, provided inside the aiming housing 200, which generates pre-recoded voice prompts when the player has been hit. In particular, the aiming speaker 234 may generate voice prompts when the remaining number of lives are critically low, such as three (3) or less, in order to warn the player. For example, when the player only has three (3) lives remaining, the voice prompt may be, e.g. "be careful," when the player only has two (2) lives remaining, the voice prompt may be, e.g. "critical stage," when the player only has one (1) last life remaining, the voice prompt may be, e.g. "one more life," and when the player only has no more lives remaining, the voice prompt may be, e.g. "game over." Such voice prompts may help the player to be informed about the current status of his/her game play and accordingly adjust the strategy for the rest of the game play, if required.

In some embodiments, the aiming speaker 234, or any other audio means, generates audio of each shot per weapon mode and each hit received by the player. The aiming speaker 234 also generates audio with the player's use of the aiming team selection button 220, the weapon selection button 224, the reload lever 226, and the trigger 214.

In an embodiment of the present disclosure, the aiming unit 102 also allows the player to play in a "stealth mode" in which the aiming team indicator light 222 is completely turned OFF or dimmed to a level such that the aiming unit 102 may not be easily exposed in dark conditions for other players to see and exploit by shooting the player. In some examples, the lights in the aiming life indicator arrangement 228 can also be turned OFF or dimmed when the "stealth mode" is engaged. In some examples, the flashlight 230 is completely turned OFF when the "stealth mode" is engaged. This maybe particularly helpful for the player to minimize exposure while trying to execute a surprise attack in the dark conditions. In the present embodiments, the player may engage the "stealth mode" for the aiming unit 102 by pressing and holding the reload lever 226 for a predetermined period of time, say, for example, three (3) seconds or more. The player may further disengage the "stealth mode" for the aiming unit 102 by again pressing and holding the reload lever 226 for the same predetermined period of time. In some examples, the "stealth mode" is activated only for a predetermined period of time, such as fifteen (15) seconds, after which the player may have to reengage the "stealth mode" if player desires.

In some examples, the "stealth mode" for the aiming unit 102 may be engaged by pressing and holding a switch on the aiming unit 102. The stealth mode gets deactivated upon being hit by an opponent. Further, in some examples, the player may be given option to engage the "stealth mode" only for a limited number of times in a single game play, for example, only once in a single game play, so that the player may be forced to make a judicious choice of when to use the option of "stealth mode" to his/her most benefit. This helps to add a strategy element to the game play, thus providing the players with better simulation of real-world battle scenarios. In some examples, engaging the "stealth mode" by a player, for example a captain of the team, may also cause the aiming units of other players of the same team to also be disposed in the "stealth mode."

Further, the aiming unit 102 may include an indication arrangement (not shown) having vibration motors or the like in order to generate vibration therein, when the infrared light signals 106 have been detected by the aiming receiver 216, i.e. when the player holding the aiming unit 102 has been hit. In some examples, the aiming unit 102 may also include means to change the intensity of the vibration generated therein as per the player's liking. It may be contemplated that the generated vibration may help to inform the player that he/she has been hit. In some examples, the aiming unit 102 may generate different types of vibrations in order to inform the player about different scenarios in the current game play; for example, a short vibration for a single hit, repetitive vibrations for multiple hits, and a long vibration to indicate that the player has lost all lives and thus has been eliminated from the current game play.

Figure 4:
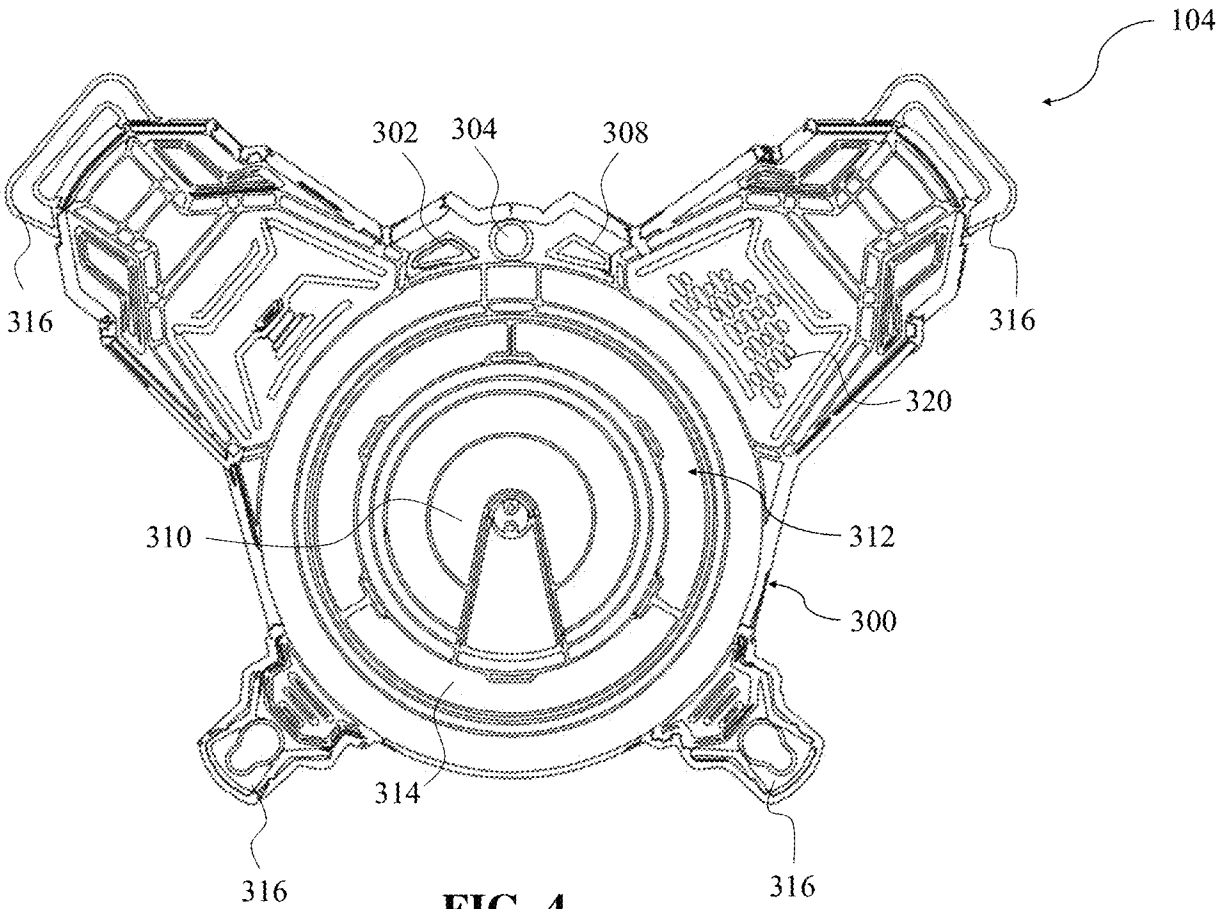
FIG. 4 illustrates a diagrammatic view of a targeting unit of the gaining device, in accordance with one or more embodiments of the present disclosure.
Figure 5:
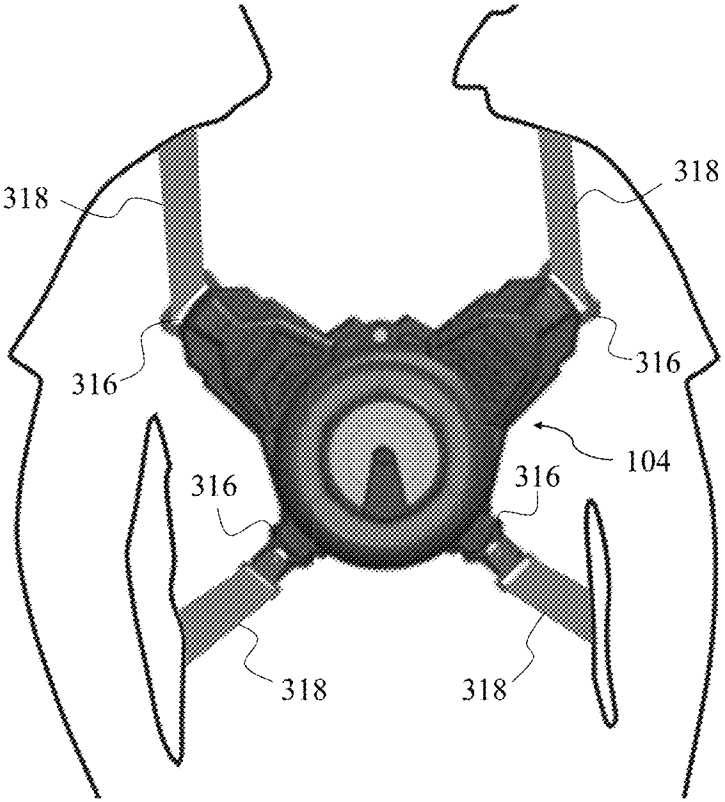
FIG. 5 illustrates a depiction of the targeting unit worn by a player during the game play, in accordance with one or more embodiments of the present disclosure.

FIG. 4 illustrates a diagrammatic view of the targeting unit 104, in accordance with one or more embodiments of the present disclosure. The targeting unit 104 may have a target housing 300 which is generally in the form of a disc and adapted to be worn by the player, typically, around chest area (as illustrated in FIG. 5), but can be worn on the back as well. The targeting unit 104 includes a switch 302 which is utilized for disposing the targeting unit 104 in ON/OFF mode. The targeting unit 104 includes at least one target receiver 304 configured to detect the infrared light signals 106 from the aiming units 102 in the vicinity and which are generally being transmitted in the direction thereof, with the target receiver 304 being the target. It may be understood that the target receiver 304 may be any sensor known in the art capable of detecting and decoding information from the infrared light signals 106, such as the infrared light signals 106 generated by the transmitter 212 of the present aiming unit 102. It may be understood that the target receiver 304 in the targeting unit 104 is generally disposed in ON mode and may automatically be switched OFF when the aiming receiver 216 in the aiming unit 102 is switched ON.

In an embodiment, the targeting unit 104 also includes a target team selection button 308. The pressing of the target team selection button 308 cycles and switches the target unit 104 between the said different pre-configured teams, i.e. "RED" team, "BLUE" team, "GREEN" team, and "ORANGE" team. In such case, the player may repeatedly press the target team selection button 308 until the same team as that of the corresponding aiming unit 102 has been selected. In some examples, the aiming unit 102 and the targeting unit 104, for the same player, are in sync (via Bluetooth, NFC, 2.4 Ghz frequency, or any other communication means), such that the targeting unit 104 may automatically be configured for the same team as that of the corresponding aiming unit 102. The targeting unit 104 may also include a target team indicator light 310 to indicate a state of the targeting unit 104. The target team indicator light 310 lights up in the color of the selected team, i.e. either in "RED" color, "BLUE" color, "GREEN" color, and "ORANGE" color to distinguish between and identify members of different teams.

As noted earlier, each player is given a limited number of lives in a game play. In an embodiment, the targeting unit 104 also includes a target life indicator arrangement 312 which indicates the state of the targeting unit 104. The target life indicator arrangement 312 indicates to the opposing player, for example, an opposing team player watching the player wearing the targeting unit 104, the number of lives remaining for that player in the game play before that particular player will be eliminated from the game. In the present examples where each player is given a total of nine (9) number of lives in a single game play, the target life indicator arrangement 312 includes three number of lights, such that each of the three lights corresponds to three (3) number of lives. Therefore, at the start of the game play, each of the three lights in the target life indicator arrangement 312 will be turned ON. When the player has been hit by an opponent three (3) number of times, the first of the three (3) lights in the target life indicator arrangement 312 will be turned OFF or dimmed. Subsequently, when the player has been again hit three (3) number of times, the second of the three (3) lights in the target life indicator arrangement 312 will be turned OFF or dimmed. And again, when the player has been hit three (3) number of times, the third of the three (3) lights in the target life indicator arrangement 312 will be turned OFF or dimmed. In sequence, the first hit by an opponent causes the first of the three (3) lights in the target life indicator arrangement 312 to blink slowly, the second hit causes the first of the three (3) lights in the target life indicator arrangement 312 to blink rapidly, and the third hit turns OFF the first of the three (3) lights in the target life indicator arrangement 312; and this sequence repeats for the second and third lights in the target life indicator arrangement 228, until all nine (9) number of lives are taken. This way by looking at the target life indicator arrangement 312, the player may be able to estimate the remaining number of lives upon exhaustion of which he/she will be eliminated from the current game play.

In an embodiment of the present disclosure, the targeting unit 104 also allows the player to play in a "stealth mode" in which the target team indicator light 310 is completely turned OFF or dimmed such that the targeting unit 104 may not be easily exposed in dark conditions for opposing players to see and exploit by shooting the player. In some examples, the target life indicator arrangement 312 is completely turned OFF or dimmed when "stealth mode" is engaged. This may be particularly helpful for the player to minimize exposure while trying to execute a surprise attack in the dark conditions. In the present embodiments, the "stealth mode" in the targeting unit 104 may automatically be engaged when the corresponding aiming unit 102 is disposed in the "stealth mode" by the player. In some embodiments, the "stealth mode" for the targeting unit 104 may be engaged by pressing and holding a switch on the targeting unit 104.

In some embodiments, the target life indicator arrangement 312 further includes an audio means, such as a target speaker 320, provided inside the target housing 300, which generates pre-recoded voice prompts when the player has been hit. In particular, the target speaker 320 may generate voice prompts when the remaining number of lives are critically low, such as three (3) or less, in order to warn the player. For example, when the player only has three (3) lives remaining, the voice prompt may be, e.g. "be careful," when the player only has two (2) lives remaining, the voice prompt may be, e.g. "critical stage,"_when the player only has one (1) last life remaining, the voice prompt may be, e.g. "one more life," and when the player only has no more lives remaining, the voice prompt may be, e.g. "game over." Such voice prompts may help the player to be informed about the current status of his/her game play and accordingly adjust the strategy for the rest of the game play, if required.

In some embodiments, the target speaker 320, or any other audio means, generates audio of each shot per weapon mode and each hit received by the player. The target speaker 320 also generates audio with the player's use of the target team selection button 308.

Further, targeting unit 104, may include an indication arrangement (not shown) having vibration motors or the like in order to generate vibration therein, when the infrared light signals 106 have been detected by the target receiver 304, i.e. when the player wearing the targeting unit 104, has been hit. In some examples, the targeting unit 104 may also include means to change the intensity of the vibration generated therein as per the player's liking. It may be contemplated that the generated vibration may help to inform the player that he/she has been hit. In some examples, the targeting unit 104 may generate different types of vibrations in order to inform the player about different scenarios in the current game play; for example, a short vibration for a single hit, repetitive vibrations for multiple hits, and a long vibration to indicate that the player has lost all lives and thus has been eliminated from the current game play.

The targeting unit 104 may further include engaging elements 316 provided with the target housing 300. As illustrated in FIG. 5, the targeting unit 104 may include straps 318 which are coupled with the engaging elements 316 and locked therewith, and further the straps 318 may be arranged on the body of the player such that the targeting unit 104 is disposed around the chest portion of the player, or on the back of the player. It may be contemplated that the described utilization of the engaging elements 316 and the corresponding straps 318 is exemplary only; and, in other examples, the targeting unit 104 may utilize any other type of means for engagement thereof with the body of the player.

In preferred examples, one or more players are equipped with both the aiming unit 102 which is held by the player in his/her hand(s) as well as the targeting unit 104 which is to be worn by the player (as illustrated in FIG. 5). In such case, the opposing player may target the targeting unit 104 of the player to gain a hit on the player. It may be understood that, according to some examples, since the aiming unit 102 also includes the aiming receiver 216, the player may be able to play the said tag game without the need of the targeting unit 104. In such examples, one or more players are equipped only with the aiming unit 102; and the opposing player may target the aiming unit 102, or particularly the aiming receiver 216 therein, to gain a hit on the player with the aiming unit 102.

In various examples, the controllers of all of the aiming units 102 in the game play may communicate with a central computer or the like, via any known communication means, such as, but not limited to, Wi-Fi. The controllers may send information related to the game play; such as, recorded number of hits received by a player, recorded number of shots delivered by a player, present weapon mode, and the like to the said central computer. The central computer may collate all the information and generate reports indicative of performances of each player in a particular game play and share such reports with the player, for example, by sending a message to a pre-registered address of the player. Further, in some examples, the said central computer may provide information related to the practice exercises for the player based on his/her previous game play for him/her to improve. Such application of the central computer, including required software and network configuration, may easily be contemplated by a person skilled in the art and thus has not been described herein for the brevity of the present disclosure.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A gaming device comprising:

a controller;

an aiming unit configured to generate infrared light signals, wherein the aiming unit comprises a reload lever configured to load a default number of shots in the aiming unit when pressed;

a receiver configured to detect the generated infrared light signals; and one or more lights configured to indicate one or more states of the aiming unit, wherein the controller is configured to engage the aiming unit in a stealth mode in which the one or more lights are switched off, and wherein the controller is configured to engage the stealth mode in the aiming unit when the reload lever is pressed for a predetermined period of time.

2. The gaming device as claimed in claim 1, wherein the receiver is provided in the aiming unit.

3. The gaming device as claimed in claim 1, further comprising a targeting unit having a secondary receiver provided therein.

4. The gaming device as claimed in claim 3, wherein the controller is configured to switch off the secondary receiver in the targeting unit, when the receiver in the aiming unit is switched on.

5. The gaming device as claimed in claim 3, wherein the controller is configured to switch on the secondary receiver in the targeting unit, when the receiver in the aiming unit is switched off.

6. The gaming device as claimed in claim 3, wherein the controller is configured to engage the stealth mode in the aiming unit and the targeting unit when the reload lever is pressed for a predetermined period of time.

7. The gaming device as claimed in claim 3, wherein the controller is configured to engage the stealth mode in the aiming unit and the targeting unit when a switch is pressed on the aiming unit.

8. The gaming device as claimed in claim 3, wherein the controller is configured to engage the stealth mode in the aiming unit and the targeting unit when a switch is pressed on the targeting unit.

9. The gaming device as claimed in claim 3, wherein the targeting unit further comprises a life indicator arrangement configured to indicate a number of lives remaining therein.

10. The gaming device as claimed in claim 3, wherein an indication arrangement disposed in one or more of the aiming unit and the targeting unit, and configured to generate a vibration in one or more of the aiming unit or the targeting unit when the corresponding receiver in the aiming unit or the targeting unit detects the infrared light signals.

11. The gaming device as claimed in claim 3, wherein one or more of the aiming unit or the targeting unit generates a vibration when the controller is configured to engage the stealth mode in one or more of the aiming unit or the targeting unit.

12. The gaming device as claimed in claim 3, wherein the aiming unit further comprises a flashlight.

13. The gaming device as claimed in claim 1, wherein the controller is configured to engage the stealth mode in the aiming unit when a switch is pressed on the aiming unit.

14. The gaming device as claimed in claim 1, wherein the aiming unit further comprises a life indicator arrangement configured to indicate a number of lives remaining therein.

15. The gaming device as claimed in claim 1, wherein the aiming unit further comprises a flashlight.

* * * * *